US006439955B1

(12) United States Patent
Feketo

(10) Patent No.: US 6,439,955 B1
(45) Date of Patent: Aug. 27, 2002

(54) TOY VEHICLE AND TRACK SYSTEM

(75) Inventor: Ferenc Feketo, Lamma Island (HK)

(73) Assignee: The Marketing Store Worldwide L.P., Westmont, IL (US)

( * ) Notice: Subject to any disclaimer, the term of this patent is extended or adjusted under 35 U.S.C. 154(b) by 0 days.

(21) Appl. No.: 09/468,735

(22) Filed: Dec. 21, 1999

(51) Int. Cl.[7] ..... A63H 18/00

(52) U.S. Cl. ..... 446/444; 446/121; 446/435; 446/445

(58) Field of Search ..... 446/120, 121, 446/429, 444, 435, 451, 452, 453, 446, 445

(56) References Cited

U.S. PATENT DOCUMENTS

| | | | | |
|---|---|---|---|---|
| 963,715 A | | 7/1910 | Kingsbury et al. | |
| 2,091,004 A | | 8/1937 | Marx | |
| 3,154,022 A | | 10/1964 | Lohr et al. | |
| 3,367,284 A | | 2/1968 | Lunzer | |
| 3,447,257 A | * | 6/1969 | Ieda | 446/460 |
| 3,540,153 A | | 11/1970 | Aoki | |
| 3,688,436 A | | 9/1972 | Wakimura | |
| 3,729,866 A | | 5/1973 | Faller et al. | |
| 3,970,309 A | * | 7/1976 | Sato | 446/460 |
| 4,068,402 A | | 1/1978 | Tanaka | |
| 4,147,351 A | * | 4/1979 | Saito | 446/446 |
| 4,198,049 A | | 4/1980 | Kurita | |
| 4,221,077 A | * | 9/1980 | Winckelmann | 446/446 |
| 4,222,195 A | | 9/1980 | Kurosawa et al. | |
| 4,455,783 A | * | 6/1984 | Nagano | 446/446 |
| 4,504,243 A | | 3/1985 | Barlow et al. | |
| 4,775,153 A | | 10/1988 | Zséger | |
| 4,795,154 A | * | 1/1989 | Lahr | 446/446 |
| 4,838,828 A | * | 6/1989 | Ohnuma | 446/446 |
| 5,405,080 A | * | 4/1995 | Yeung et al. | 446/446 |
| 5,441,435 A | | 8/1995 | Shiraishi | |
| 5,928,058 A | * | 7/1999 | Francis et al. | 446/446 |
| 6,062,942 A | * | 5/2000 | Ogihara | 446/444 |

* cited by examiner

*Primary Examiner*—Jacob K. Ackun
*Assistant Examiner*—Faye Francis
(74) *Attorney, Agent, or Firm*—Brinks Hofer Gilson & Lione

(57) ABSTRACT

A toy vehicle and track system that allows a vehicle to operate along a single track length by performing U-turns at each end of the track length. When multiple track lengths are attached together, U-turn stoppers are retracted so that the vehicle travels along the entire track assembly and performs U-turns at the ends of the track assembly. Additionally, when multiple track lengths are attached in a loop formation, all the U-turn stoppers are retracted so that the vehicle travels in a continuous circular-like path. A control system is also provided that allows a rear vehicle to initiate operation of a front vehicle.

14 Claims, 3 Drawing Sheets

TOY VEHICLE AND TRACK SYSTEM

FIELD OF THE INVENTION

This invention relates generally to toy vehicles. It relates particularly to a toy vehicle and track system.

BACKGROUND OF THE INVENTION

Self-propelled toy vehicles which run along a track and use a guide pin in a groove for guidance are well-known within the toy industry. In a typical toy vehicle of this nature, a guide pin is fixed to the underside of the vehicle, and a mating groove runs lengthwise through the upper side of the track. The vehicle includes wheels and a source of power for driving the wheels so that the vehicle travels along the track. However, the vehicle is restrained by the guide pin and groove so that the vehicle remains on the track as it travels.

Also well-known in the toy industry are detachable track systems in which multiple sections of tracks can be attached to each other, end-to-end, to create track assemblies of varying lengths and shapes. Examples of such track assemblies can be found in conventional toy train sets and electrically operated toy race car systems.

Traditional toy vehicle and track systems are typically relatively expensive, however, because an entire set of tracks must be purchased in order to obtain full enjoyment from the toy. A single track section is usually inoperative by itself, and is only useful after being attached to a number of other track sections. Further, the vehicles in these systems are often limited in the way they can be used. For example, in a conventional train set, the train usually repetitiously follows the same travel path, over and over.

Because of the higher cost and the functional limitations of a system that requires a complete track, these conventional toy vehicle and track systems are usually sold as retail products through traditional toy stores. They are not practical for another important outlet for toy products; as premiums associated with the marketing of non-toy products to children. In this regard, non-toy retailers will often include an inexpensive toy with their product. The toy encourages the child to choose the retailer's primary, nontoy product over competing retailers' products and increases the child's overall satisfaction with the purchase.

It is therefore desirable to have a toy vehicle and track system which is operable with a vehicle and single track section and is inexpensive. It is also desirable to have a toy vehicle and track system which can be used with multiple track sections connected together.

BRIEF SUMMARY OF THE INVENTION

It is an object of the invention to provide a toy vehicle and track system which is operable with a single track section.

It is another object to provide a system which allows the vehicle to operate along multiple, connected track sections.

It is still another object to provide a system which allows one vehicle to initiate operation of another vehicle.

According to the invention, a toy vehicle travels along a track section, and its direction is controlled by a guide pin on the bottom of the vehicle. The pin travels within a guide slot on the track section. A stopper is provided within the guide slot at each end of a track section. The stoppers each include a ramp and a stop which cause the vehicle to perform a U-turn when the vehicle encounters the stopper. A retraction mechanism retracts the stoppers when two track sections are attached to each other, thereby allowing the vehicle to travel along the two track sections without performing a U-turn.

Additionally, the guide pin is pivotally mounted on the vehicle. When the pin is pivoted to an inoperative position, it permits the vehicle to be operated on a flat surface.

A control system is provided which enables one vehicle to initiate the operation of another vehicle. A multiple position button protruding from the rear of each vehicle locks the vehicle motor when it is pulled out and releases the motor when it is pushed in. When a trailing vehicle in the same travel path contacts the multiple position button of a leading vehicle, the trailing vehicle will push in the multiple position button of the leading vehicle, thereby releasing the leading vehicle to move ahead under its own power.

BRIEF DESCRIPTION OF SEVERAL VIEWS OF THE DRAWINGS

The invention, including its construction and method of operation, is illustrated more or less diagrammatically in the drawings in which.

DETAILED DESCRIPTION OF THE INVENTION

Figure 1:
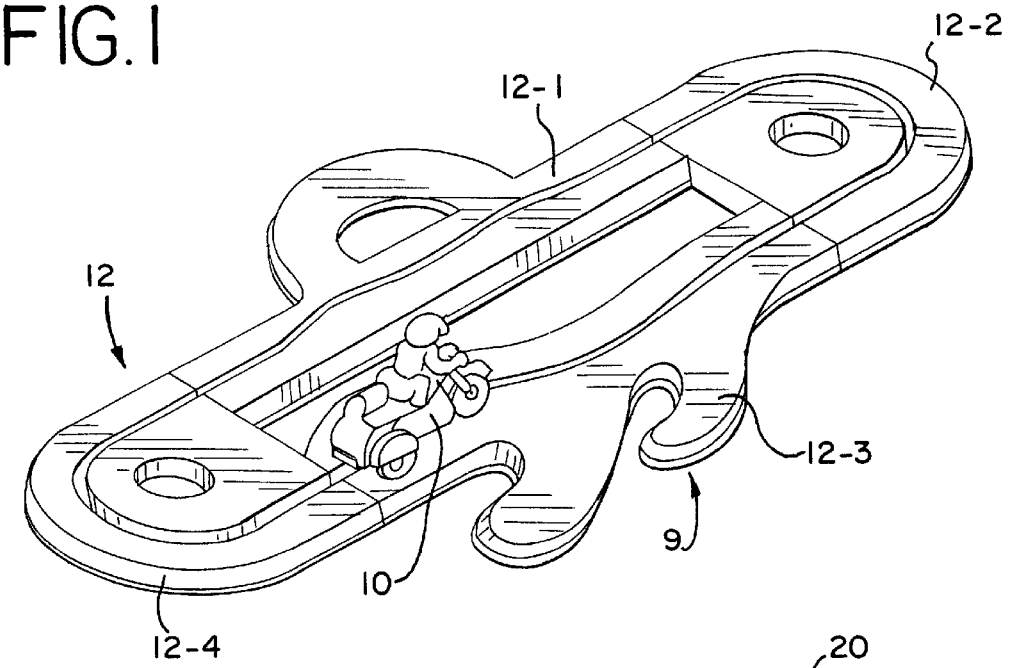
FIG. 1 is a perspective view of a toy vehicle and track system, showing a single vehicle and four track sections connected together in a loop.

Referring now to the drawings, and particularly to FIG. 1, a toy vehicle and track system embodying features of the invention is shown at 9. The system includes a toy vehicle 10 and track assembly 12. The vehicle 10 of the present invention can operate in several different modes. In FIG. 1 the vehicle 10 is shown operating on a track assembly 12 which forms a continuous loop so that the vehicle 10 can travel continuously around the track assembly 12. The track assembly 12 includes track sections 12-1, 12-2, 12-3 and 12-4.

Figure 2:
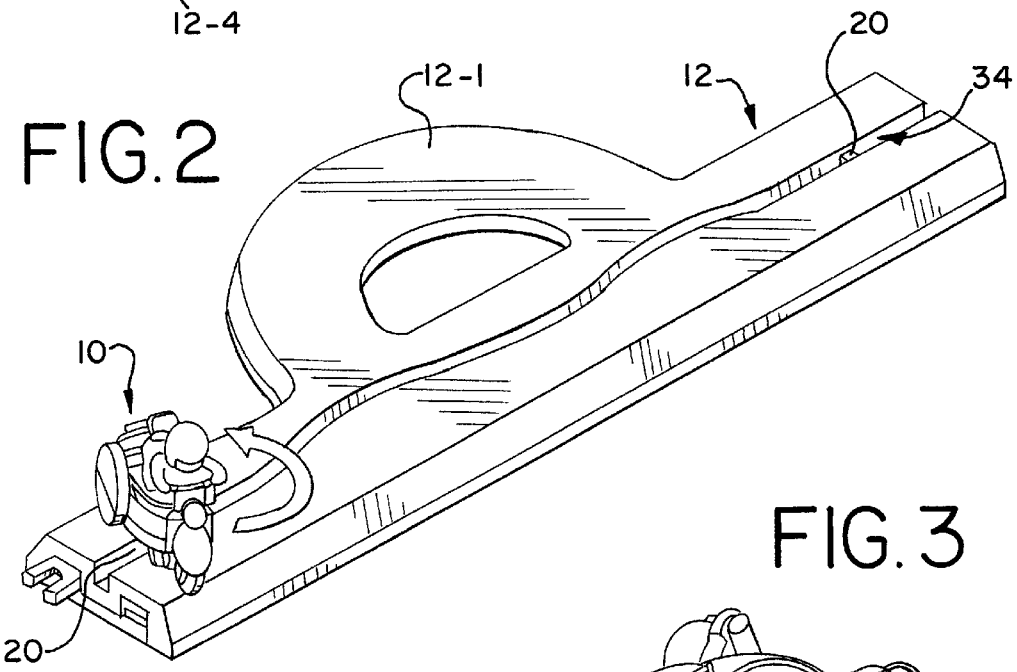
FIG. 2 is a perspective view of a toy vehicle and track system, showing a single track section and a single vehicle performing a U-turn at the end of the track section.

Turning now to FIG. 2, a feature of the invention is the ability of the vehicle 10 to operate effectively on a single track section 12-1. In order to facilitate operation along a single track section 12-1, the track section 12-1 is provided with a stopper 20 at each end. A vehicle 10 will then travel along the track section 12-1 until it engages the stopper 20 at the end of the track length 12. Upon engagement with the stopper 20, the vehicle 10 will perform a U-turn and will travel along the track length 12 in the opposite direction. The vehicle 10 will repeat this back and forth travel between the two ends of the track section 12-1 until its stored energy is exhausted.

Figure 3:
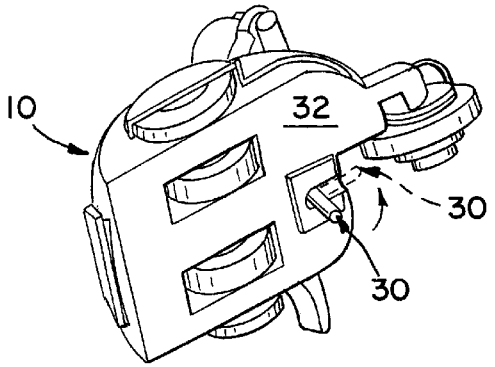
FIG. 3 is a perspective view of a vehicle, showing the vehicle turned on its side to illustrate the bottom of the vehicle.

Turning to FIG. 3, a guide pin 30 is provided on the bottom 32 of the body 14 of the vehicle 10. As is well-known by those skilled in the art, a guide pin 30 is designed to travel within the guide slot 34 of each track section 12 in order to control the travel path of the vehicle 10. The guide pin 30 in the vehicle 10 of the present invention may be positioned to allow the vehicle 10 to be operated either on a track section 12 or on a flat surface, such as a table top.

To this end, the guide pin 30 is pivotally mounted on the bottom of the vehicle body 14. The guide pin 30 can be pivoted down so that the guide pin 30 will engage the guide slot 34 of a track section 12, or it can be pivoted up so that the guide pin 30 does not interfere with vehicle 10 travel along a flat surface.

Figure 4:
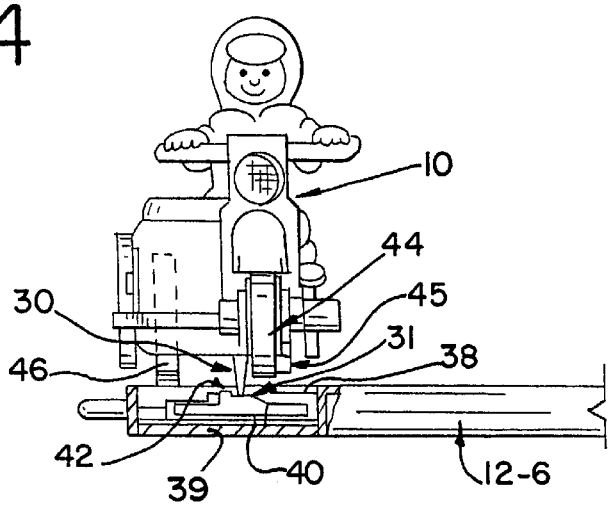
FIG. 4 is an elevational view of one end of a track section with a vehicle performing a U-turn, showing a part of the track section broken away to illustrate the internal mechanisms.
Figure 5:
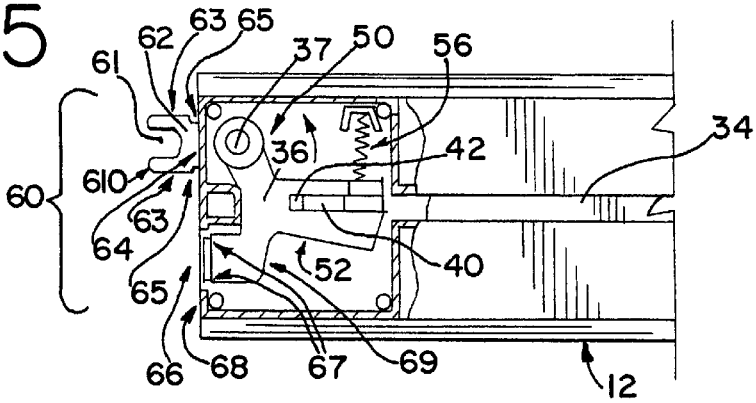
FIG. 5 is a top view of one end of a track section, showing a portion of the top surface of the track section broken away to illustrate the internal mechanisms.
Figure 6:
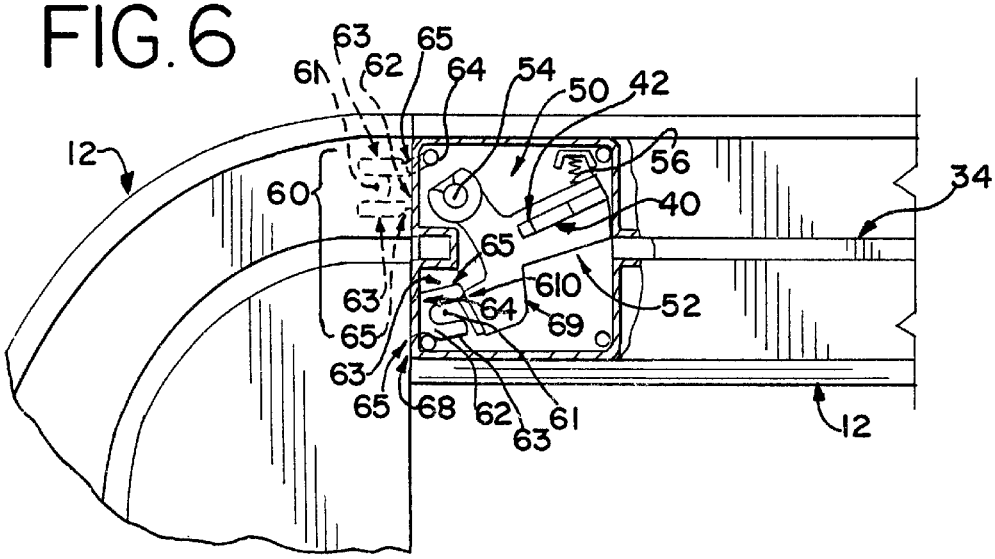
FIG. 6 is a top view of the ends of two track sections attached together, showing a portion of the top surfaces of the track sections broken away to illustrate the internal mechanisms.

Turning to FIGS. 4–6, to cause a U-turn by the vehicle 10 at either end of the track section 12-1, a stopper 20 is provided. Each stopper 20 includes a generally Y-shaped plate 36 pivotally mounted at 37 in the track section 12-1 between the roof 38 and base 39 of the section 12-1. The plate 36 carries a ramp element 40 and a stop 42.

The vehicle 10 travels along the slot 34. When the guide pin 30 reaches the stopper 20, the bottom end of the guide pin 30 engages the ramp element 40 and rides upon it. The guide pin 30 is located on the transverse centerline of the vehicle 10, or forward thereof, so that the front wheel 44 of the vehicle 10 is raised as the guide pin 30 follows the ramp element 40 upward. The guide pin 30 is also located to one side of the vehicle 10, spaced from the longitudinal center line, so that the inside rear wheel 45 is raised as the guide pin 30 follows the ramp element 40 upward.

At the end of the ramp element 40, the stop 42 blocks the guide pin 30 from further forward travel. When the guide pin 30 contacts the stop 42, the outer rear wheel 46 will continue driving the vehicle 10. Instead of driving the vehicle 10 forward, however, the outer rear wheel 46 will drive the vehicle 10 so as to rotate around its guide pin 30.

Once the vehicle 10 rotates a full one hundred and eighty degrees and the stop 42 is no longer blocking its forward travel, the vehicle 10 will proceed along its path in the opposite direction. In order to improve U-turn performance, the rear drive wheels 45, 46 are coated with a soft compound to increase traction.

As best seen in FIG. 5, a retraction mechanism 50 is provided for positioning the stopper 20 with the ramp 40 and stop 42 within the guide slot 34 or with the ramp and stop outside the guide slot 34. According to the invention, the stopper 20 is positioned within the guide slot 34 when the track section 12-1 is detached from other track sections 12 and is positioned outside the guide slot 34 when the track section 12-1 is attached to other track sections 12. A spring 56 biases the stopper 20 into its position within the guide slot 34 when the track section 12-1 is detached from other track sections 12.

A connecting mechanism 60 is provided for connecting multiple track sections 12 together in order to lengthen the travel path available to the vehicle 10. The connecting mechanism 60 of each track section 12 includes a connecting tab 62 that extends longitudinally beyond each end 68 of the track section 12. The connecting tab 62 contains a cut-out 61 that allows the sides 63 of the tabs 62 to flex inward. Along the base 64 of the tab 62 are undercut areas 65.

An opening 66 that corresponds to the connecting tab 62 is provided on a mating track section 12. Thus, when two track sections 12 are attached together, the connecting tabs 62 are inserted into the corresponding openings 66. As the tabs 62 enter the openings 66, the sides 63 of the connecting tabs 62 are flexed inward by the sides 67 of the openings 66. Once the ends 68 of the track sections 12 are fully abutted against each other, the sides 63 of the connecting tabs 62 flex back to their free state, and the undercut areas 65 serve as detents to lock the two track sections 12 together.

Insertion of the connecting tabs 62 also retracts the stoppers 20 of the track sections 12 so that the stoppers 20 are no longer positioned within the guide slots 34. This is accomplished by a leg 69 of the plate 36 that is positioned near the opening 66 which corresponds to the connecting tab 62. When the connecting tab 62 is inserted into its corresponding opening 66, the end of the tab 62 engages the leg 69 of the lever 36 and forces the plate 36 to rotate about its pivot axis 37. As the plate 36 rotates, the spring 56 is compressed, and the stopper 20 is rotated away from the guide slot 34.

Therefore, as is now readily apparent, the stopper 20, the retraction mechanism 50 and the connecting mechanism 60 permit the toy vehicle and track system 10 to operate in several different modes. First, when a single track section 12-1 is detached from other track sections 12 on both ends, the vehicle 10 will travel back and forth along the track section 12-1 by performing U-turns at each end. Second, when multiple track sections 12 are attached together in a non-loop formation, the vehicle 10 will travel back and forth along the multiple sections by performing U-turns at the detached ends. Third, when multiple track sections 12 are attached together in a loop formation, the vehicle 10 will travel in a continuous path around them without performing any U-turns.

Figure 7:
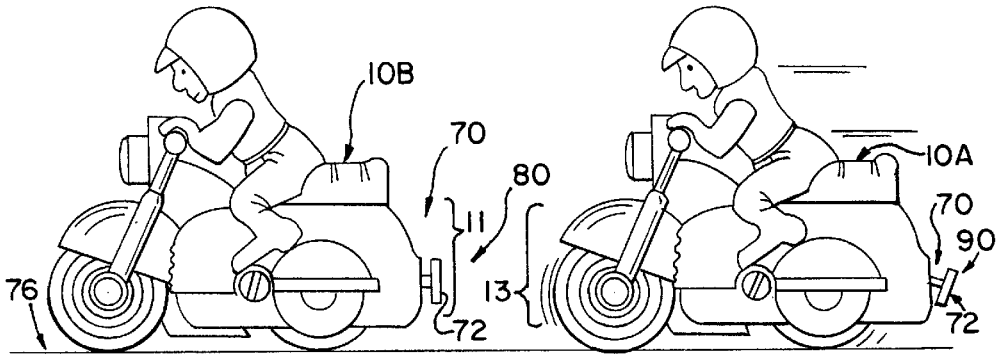
FIG. 7 is an elevational view of two vehicles operating on a flat surface, showing the front end of a trailing vehicle about to contact the rear end of a leading vehicle.
Figure 8:
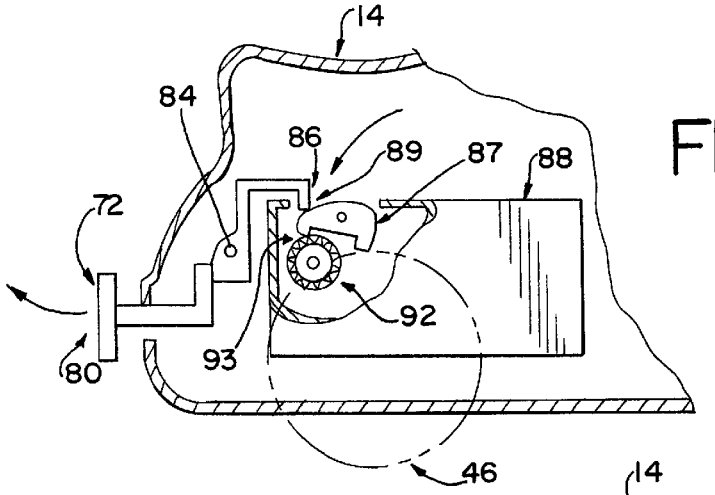
FIG. 8 is an elevational view of a rear end of a vehicle with the multiple position button pulled out, showing a portion of the vehicle body broken away, and a portion of the motor housing broken away, to illustrate the multiple position button in the locked position.
Figure 9:
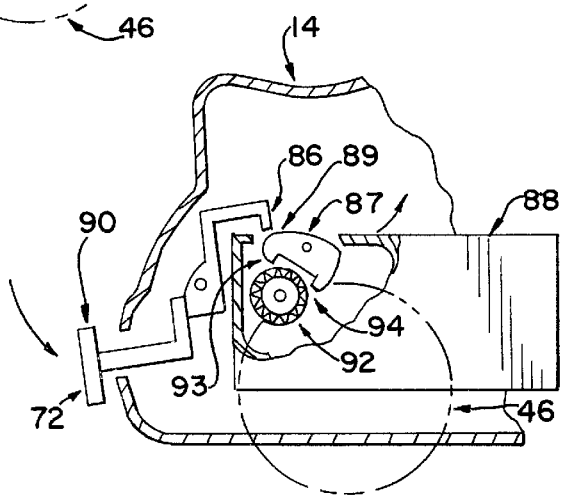
FIG. 9 is an elevational view of a rear end of a vehicle with the multiple position button pushed in, showing a portion of the vehicle body broken away, and a portion of the motor housing broken away, to illustrate the multiple position button in the released position.

Turning to FIGS. 7–9, the vehicles 10 are also provided with a control system 70 that further increases the number of operating modes available. The control system 70 includes a multiple position button 72 incorporated into the rear end 11 of the vehicle body 14. When the button 72 is pulled out, the motor 88 is locked and the energy potential of the motor 88 is stored. When the button 72 is pushed in, the motor 88 is released and the motor 88 freely drives the wheels 45, 46 of the vehicle 10.

This control system 70 allows one vehicle 10A to initiate operation of another vehicle 10B. For example, the user can energize the motor 88 of a leading vehicle 10B by winding up its energy storage mechanism (not shown) while the button 72 is pulled out. The leading vehicle 10B will then be locked in a high potential energy state, and placed at a desired beginning position. By placing the trailing vehicle 10A so that its travel path causes its front end 13 to contact the rear end 11 of the leading vehicle 10B and its multiple position button 72, the trailing vehicle 10A will push the button 72 of the leading vehicle 10B in upon contact, and the leading vehicle 10B will then be released to begin its own travel path.

As seen best in FIGS. 8 and 9, the multiple position button 72 is pivotally connected at 84 to the body 14 of the vehicle 10, thereby facilitating the outward position 80 and inward position 90 of the button 72. Fixedly attached to the opposite end of the button 72 is a lever 86 that moves in a generally upward and downward direction as the button 72 is pushed in 90 and pulled out 80, respectively. The vehicle 10 uses a wind up motor 88 with a governor member 87 to control its speed, which is a well-known motor configuration to those skilled in the art of toy vehicles.

In normal operation, the governor member 87 controls the speed of the motor 88 by engaging the teeth of a gear 92 alternately in two places 93, 94. As the gear 92 rotates, the governor 87 oscillates between the two places 93, 94 of tooth engagement and slows the speed of the gear 92.

In order to lock the motor 88 and store its energy potential, the multiple position button 72 is pulled out to position 80. The lever 86 then moves downward, contacting the top 89 of the governor member 87 and forcing the governor member to fixedly engage the gear 92 in one of the places 93 of the tooth engagement. A conventional friction or detent device is provided to retain the button 72 in its outward position 80 until the button 72 is pushed into position 90 by the user.

To release the motor 88, the button 72 is pushed in to position 90, which causes the lever 86 to move upward. This disengages the governor element and allows the governor element to function normally.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

I claim:

1. A toy vehicle and track system, comprising:

a) a vehicle having a plurality of wheels and a guide pin attached to a bottom side of said vehicle;

b) a track length with a guide slot that the guide pin can travel within;

c) a retractable stopper extendable within said guide slot in an unretracted position for engaging said guide pin, including i) a stop portion, and ii) a ramp portion;

d) a retraction mechanism for retracting the stopper so that said stopper is not positioned within said guide slot in a retracted position; and e) a track connecting mechanism for attaching and detaching multiple track lengths together, wherein i) said retraction mechanism positions said stopper in said unretracted position when the track connecting mechanism of two track lengths is detached, and ii) said retraction mechanism positions said stopper in said retracted position when the track connecting mechanism of two track lengths is attached.

2. The toy vehicle and track system according to claim 1, wherein said guide pin is further located in a forward position so that a front wheel of said vehicle is lifted upward when the guide pin engages said stopper.

3. The toy vehicle and track system according to claim 1, wherein said guide pin is located away from the longitudinal centerline of the vehicle so that an inside wheel is lifted upward and an outside wheel engages a surface of said track length when the guide pin engages said stopper, thereby causing said vehicle to rotate around the guide pin.

4. The toy vehicle and track system according to claim 3, wherein a rear wheel of said vehicle is provided with a friction-enhancing surface which improves traction for rotating the vehicle around said guide pin at said stopper.

5. The toy vehicle and track system according to claim 3, wherein the stopper further comprises a pivotable member, wherein:

a) said stopper is fixedly connected to said pivotable member; and b) said member is pivotally connected to said track length so that said stopper can be rotated to be positioned within or without said guide slot of said track length.

6. The toy vehicle and track system according to claim 5, wherein the stopper further comprises:

a) a biasing mechanism that positions said stopper within said guide slot of said track length when said connecting mechanism of two track lengths is detached; and b) an arm of said pivotable member that is engaged by said connecting mechanism and forces the member against said biasing mechanism so that said stopper is positioned without said guide slot of said track length when said connecting mechanism of two track lengths is attached.

7. The toy vehicle and track system according to claim 6, wherein said track connecting mechanism comprises connecting tabs, and:

a) said connecting tab of a first track length engages said arm of said pivotable member of a second track length thereby positioning said stopper without said guide slot of said second track length; and b) said connecting tab of said first track length also securably attaches the first track length to said second track length.

8. The toy vehicle and track system according to claim 7, wherein said pivotal connection of said member is about a vertical axis that is parallel to said guide slot of said track length.

9. The toy vehicle and track system according to claim 8, wherein a rear wheel of said vehicle is provided with a friction-enhancing surface which improves traction for rotating the vehicle around said guide pin at said stopper.

10. The toy vehicle and track system according to claim 9, wherein said guide pin is a multiple position guide pin, wherein:

a) said pin extends downwards in a first position so that the pin can travel within said guide slot of said track length; and b) said pin does not extend downwards in a second position so that said vehicle can operate along a flat surface without the pin travelling within said guide slot.

11. The toy vehicle and track system according to claim 1, wherein said guide pin is a multiple position guide pin, wherein:

a) said pin extends downwards in a first position so that the pin can travel within said guide slot of said track length; and b) said pin does not extend downwards in a second position so that said vehicle can operate along a flat surface without the pin travelling within said guide slot.

12. The toy vehicle and track system according to claim 1, wherein the stopper further comprises a pivotable member, wherein:

a) the stopper is fixedly connected to said pivotable member; and b) said pivotable member is pivotally connected to said track length so that said stopper can be rotated to be positioned within or without said guide slot of said track length.

13. The toy vehicle and track system according to claim 12, wherein the stopper further comprises:

a) a biasing mechanism that positions said stopper within said guide slot of said track length when said connecting mechanism of two track lengths is detached; and b) an arm of said pivotable member that is engaged by said connecting mechanism and forces the pivotable member against said biasing mechanism so that said stopper is positioned without said guide slot of said track length when said connecting mechanism of two track lengths is attached.

14. A toy vehicle and track system, comprising:

a) a first track section and a second track section, the first and second track sections each having a guide slot thereon extending between opposite ends thereof;

b) a retractable stopper adjacent one end of said first track section and extendable within said guide slot in an unretracted position;

c) a retraction mechanism for retracting the stopper so that said stopper is not positioned within said guide slot in a retracted position; and d) a track connecting mechanism for attaching and detaching said first and second track sections together, wherein i) said retraction mechanism positions said stopper in said unretracted position when the track connecting mechanism is detached, and ii) said retraction mechanism positions said stopper in said retracted position when the track connecting mechanism is attached.

* * * * *

UNITED STATES PATENT AND TRADEMARK OFFICE

CERTIFICATE OF CORRECTION

PATENT NO. : 6,439,955 B1 
DATED : August 27, 2002
INVENTOR(S) : Ferenc Fekete

It is certified that error appears in the above-identified patent and that said Letters Patent is hereby corrected as shown below:

Title page,
Item [12], delete "Feketo" and substitute -- Fekete -- in its place.
Item [75], delete "Feketo" and substitute -- Fekete -- in its place.

Signed and Sealed this

Twenty-ninth Day of April, 2003

JAMES E. ROGAN
*Director of the United States Patent and Trademark Office*